US007612734B2

(12) United States Patent
Tsai et al.

(10) Patent No.: US 7,612,734 B2
(45) Date of Patent: Nov. 3, 2009

(54) WIDE BANDWIDTH ANTENNA DEVICE

(75) Inventors: Tiao-Hsing Tsai, Tao Yuan Shien (TW); Chieh-Ping Chiu, Tao Yuan Shien (TW); Chih-Wei Liao, Tao Yuan Shien (TW); Chi-Yin Fang, Tao Yuan Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 42 days.

(21) Appl. No.: 12/004,315

(22) Filed: Dec. 19, 2007

(65) Prior Publication Data

US 2009/0021448 A1 Jan. 22, 2009

(30) Foreign Application Priority Data

Jul. 16, 2007 (TW) ..... 96125821 A

(51) Int. Cl.
*H01Q 1/38* (2006.01)
*H01Q 21/00* (2006.01)

(52) U.S. Cl. ..... 343/893; 343/700 MS

(58) Field of Classification Search ..... 343/700 MS, 343/702, 893
See application file for complete search history.

(56) References Cited

U.S. PATENT DOCUMENTS 6,134,421 A * 10/2000 Lee et al. ..... 455/575.9
6,891,506 B2 * 5/2005 Jarmuszewski et al. ..... 343/702
6,980,154 B2 * 12/2005 Vance et al. ..... 343/700 MS
6,980,173 B2 * 12/2005 Man et al. ..... 343/841
7,148,846 B2 * 12/2006 Qi et al. ..... 343/700 MS
7,400,300 B2 * 7/2008 Qi et al. ..... 343/700 MS

* cited by examiner

*Primary Examiner*—James H. Cho
*Assistant Examiner*—Crystal L Hammond
(74) *Attorney, Agent, or Firm*—David N. Lathrop

(57) ABSTRACT

An antenna device includes a dielectric substrate, first and second antennas, and a parasitic coupler. The first antenna is formed on the dielectric substrate, and includes first and second radiating elements that extend in opposite directions. The parasitic coupler is formed on the dielectric substrate and is electromagnetically coupled to the first radiating element. The second antenna is formed on the dielectric substrate and is disposed proximate to the second radiating element.

10 Claims, 26 Drawing Sheets

Peak = -2.94 dBi, Avg. = -5.43 dBi.

Peak = -0.05 dBi, Avg. = -2.93 dBi.

Peak = 0.1 dBi, Avg. = -3.7 dBi.

Peak = 3.3 dBi, Avg. = -1.56 dBi.

Peak = -0.96 dBi, Avg. = -5.15 dBi.

Peak = 2.84 dBi, Avg. = -1.76 dBi.

Peak = 1.1 dBi, Avg. = -0.76 dBi.

Peak = 2.79 dBi, Avg. = -2.18 dBi.

Peak = 2.51 dBi, Avg. = -2.21 dBi.

Peak = -0.93 dBi, Avg. = -3.05 dBi.

Peak = 1.27 dBi, Avg. = -3.62 dBi.

Peak = 1.63 dBi, Avg. = -2.55 dBi.

Peak = 1.6 dBi, Avg. = -2.81 dBi.

Peak = -1.01 dBi, Avg. = -4.7 dBi.

WIDE BANDWIDTH ANTENNA DEVICE

CROSS-REFERENCE TO RELATED APPLICATION

This application claims priority of Taiwanese application no. 096125821, filed on Jul. 16, 2007.

BACKGROUND OF THE INVENTION

1. Field of the Invention

The invention relates to an antenna device, more particularly to an antenna device that has a wide bandwidth.

2. Description of the Related Art

A conventional antenna device, which operates in the wireless wide area network (WWAN) band and the wireless local area network (WLAN) band, has a three-dimensional shape, and is therefore easily deformed during assembly. This undesirably affects operation of the conventional antenna device.

SUMMARY OF THE INVENTION

Therefore, the object of the present invention is to provide an antenna device that can overcome the aforesaid drawback of the prior art.

According to the present invention, an antenna device comprises a dielectric substrate, first and second antennas, and a parasitic coupler. The first antenna is formed on the dielectric substrate, and includes a first feeding element that has opposite ends, a feeding point that is disposed at one of the ends of the first feeding element, and first and second radiating elements that respectively extend from opposite sides of the other one of the ends of the first feeding element in opposite directions. The parasitic coupler is formed on the dielectric substrate, is disposed proximate to the first radiating element, and includes a first grounding element, and a coupling element that extends from the first grounding element and that is electromagnetically coupled to the first radiating element. The second antenna is formed on the dielectric substrate, is disposed proximate to the second radiating element, and includes a second feeding element that has opposite ends, a second feeding point that is disposed at one of the ends of the second feeding element, third and fourth radiating elements that respectively extend from opposite sides of the other one of the ends of the second feeding element, and a second grounding element that extends from the second feeding element.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
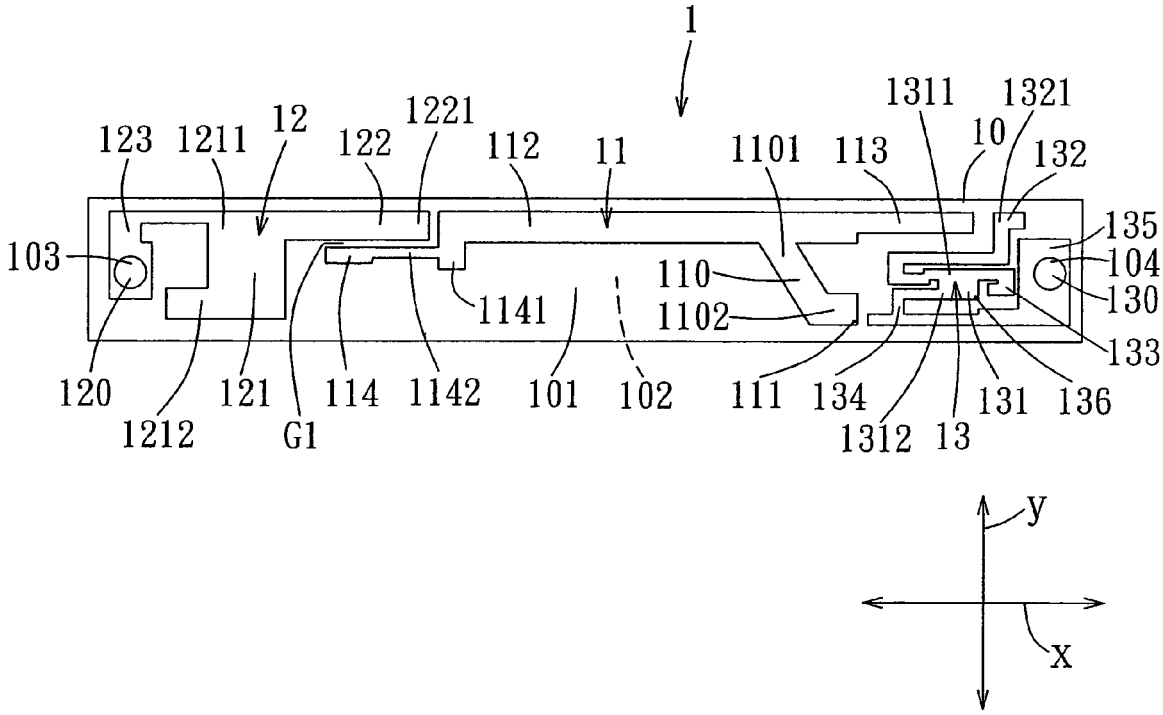
FIG. 1 is a schematic view of the first preferred embodiment of an antenna device according to the present invention.

Before the present invention is described in greater detail, it should be noted that like elements are denoted by the same reference numerals throughout the disclosure.

Referring to FIG. 1, the first preferred embodiment of an antenna device 1 according to this invention is shown to include a dielectric substrate 10, first and second antennas 11, 13, and a parasitic coupler 12.

The antenna device 1 of this embodiment is suitable for wireless wide area network (WWAN) and wireless local area network (WLAN) applications. WWAN uses technology that operates in: the third generation (3G) mobile communications system frequency range, i.e., between 824 MHz and 960 MHz and between 1710 and 2170 MHz; the global positional system (GPS) frequency range, i.e., between 1565 MHz and 1585 MHz; and the digital video broadcasting-handheld (DVB-H) frequency range, i.e., between 1670 MHz and 1675 MHz. WLAN, on the other hand, uses technology that operates in the 802.11 a/b/g frequency range, i.e., between 2400 MHz and 2488 MHz and between 4900 MHz and 5875 MHz.

The dielectric substrate 10 has opposite first and second surfaces 101, 102. In this embodiment, the dielectric substrate 10 is made from a plastic material.

The first and second antennas 11, 13 and the parasitic coupler 12 are formed on the first surface 101 of the dielectric substrate 10. In this embodiment, the first and second antennas 11, 13 and the parasitic coupler 12 are made from copper foil. In an alternative embodiment, the first and second antennas 11, 13 and the parasitic coupler 12 are made from iron or copper plate material.

It is noted that the antenna device 1 of this embodiment may be implemented with the use of a single-sided printed circuit board.

The parasitic coupler 12 and the second antenna 13 are spaced apart from each other in a first direction (X) and are respectively disposed at left and right sides of the dielectric substrate 10. The first antenna 11 is spaced apart from and is disposed between the parasitic coupler 12 and the second antenna 13.

The first antenna 11 is a dual-band monopole antenna, and includes a first feeding element 110, a first feeding point 111, and first and second radiating elements 112, 113.

The first feeding element 110 has a first end 1101 that has opposite left and right sides, and a second end 1102 that is opposite to the first end 1101 thereof.

The first feeding point 111 is provided on the second end 1102 of the first feeding element 110.

The first radiating element 112 extends in the first direction (X) from the left side of the first end 1101 of the first feeding element 110 away from the second antenna 13, and has a coupling end portion 114. In this embodiment, the coupling end portion 114 of the first radiating element 112 is generally L-shaped, and includes first and second legs 1141, 1142.

The second radiating element 113 extends in the first direction (X) from the right side of the first end 1101 of the first feeding element 110 away from the parasitic coupler 12.

In this embodiment, the first radiating element 112 has a length longer than that of the second radiating element 113.

The parasitic coupler 12 includes a first grounding element 121, a coupling element 122, and a first securing element 123.

The first grounding element 121 has a first end 1211 that has left and right sides, and a second end 1212 that is opposite to the first end 1211 thereof.

The coupling element 122 extends in the first direction (X) from the right side of the first end 1211 of the first grounding element 121 toward the second antenna 13, and has a coupling end portion 1221 that is electromagnetically coupled to the coupling end portion 114 of the first radiating element 112 so as to permit operation of the first antenna 11 in the 3G mobile communications system frequency range, the GPS frequency range, and the DVB-H frequency range.

The first securing element 123 extends from the left side of the first end 1211 of the first grounding element 121 thereof.

The second end 1212 of the first grounding element 121 of the parasitic coupler 12 is coupled to an electrical ground (not shown).

In this embodiment, the second leg 1142 of the coupling end portion 114 of the first radiating element 112 and the coupling element 122 overlap in a second direction (Y) transverse to the first direction (X), and cooperatively define a gap (G1) therebetween that ranges from 0.5 millimeters to 3.0 millimeters.

It is noted herein that the electromagnetic coupling between the coupling end portion 114 of the first radiating element 112 and the coupling element 122 may be increased or decreased, for the purpose of impedance matching, by simply adjusting the gap (G1).

The second antenna 13 is a dual-band planar inverted-F antenna (PIFA), and includes a second feeding element 131, a second feeding point 136, third and fourth radiating elements 132, 133, a second grounding element 134, and a second securing element 135.

The second feeding element 131 has a first end 1311 that has opposite left and right sides, and a second end 1312 that is opposite to the first end 1311 thereof.

The second feeding point 136 is provided on the second end 1312 of the second feeding element 131.

The third radiating element 132 is operable between 2400 MHz and 2488 MHz, and extends along a meandering course from the left side of the first end 1311 of the second feeding element 131. In this embodiment, the third radiating element 132 has an end portion 1321 that overlaps with the second radiating element 113 in the first direction (X).

The fourth radiating element 133 is operable between 4900 MHz to 5875 MHz, and extends along a meandering course from the right side of the first end 1311 of the second feeding element 131.

In this embodiment, the third radiating element 132 has a length longer than that of the fourth radiating element 133.

The second grounding element 134 extends from the second end 1312 of the second feeding element 131.

The second securing element 135 extends from the second grounding element 134.

The antenna device 1 of this embodiment may be secured to an electronic device (not shown), such as a notebook computer, with the use of a pair of screws (not shown). In particular, each of the first and second securing elements 123, 135 is formed with a hole 120, 130 therethrough. The dielectric substrate 10 is formed with a pair of through-holes 103, 104, each of which is aligned with the hole 120, 130 in a respective one of the first and second securing elements 123, 135. Each of the screws is inserted through one of the holes 120, 130 and a respective one of the through-holes 103, 104, and is threadedly engaged to the electronic device.

Figure 2:
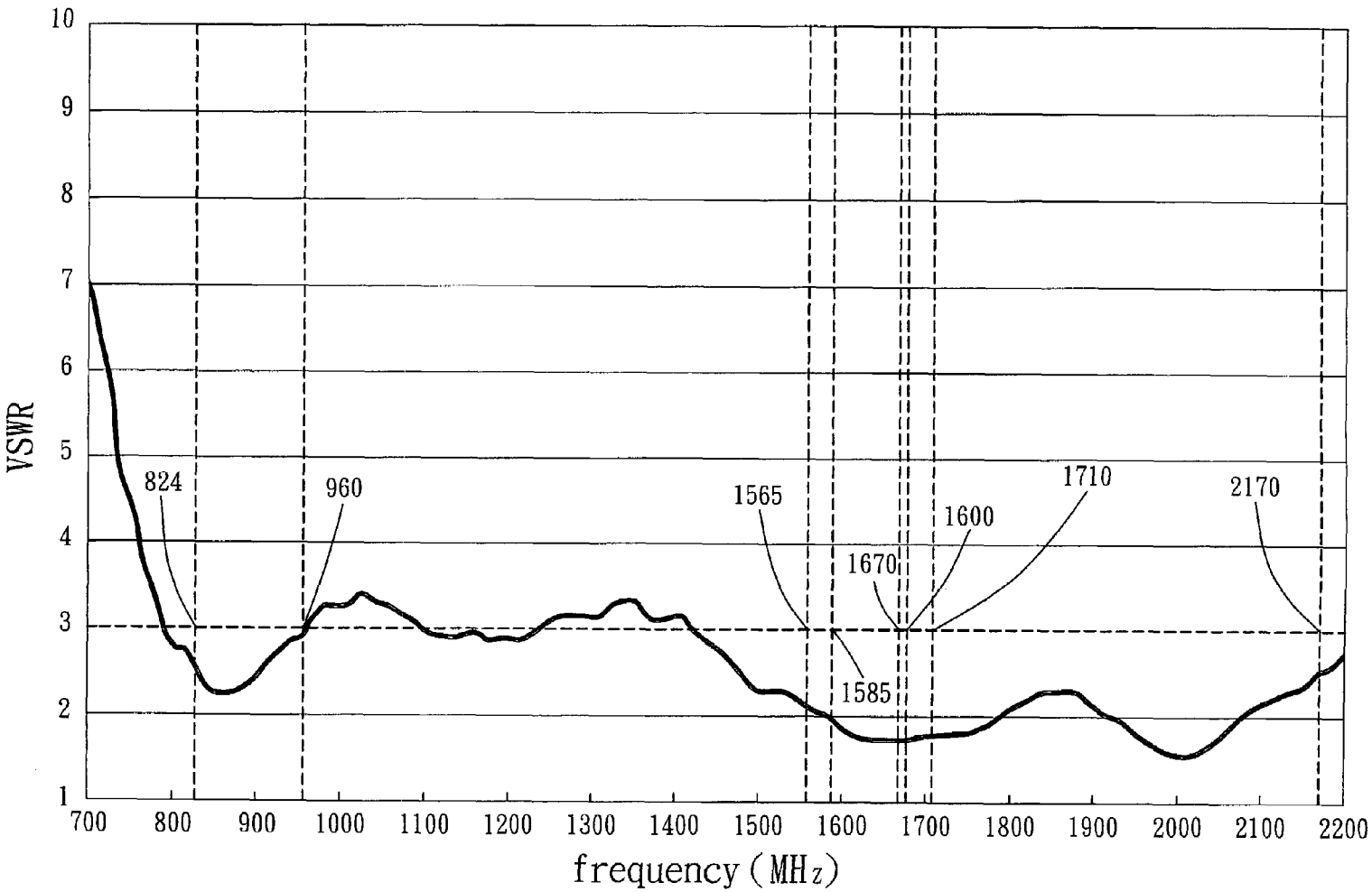
FIGS. 2 and 3 are plots illustrating voltage standing wave ratios of the first preferred embodiment.
Figure 3:
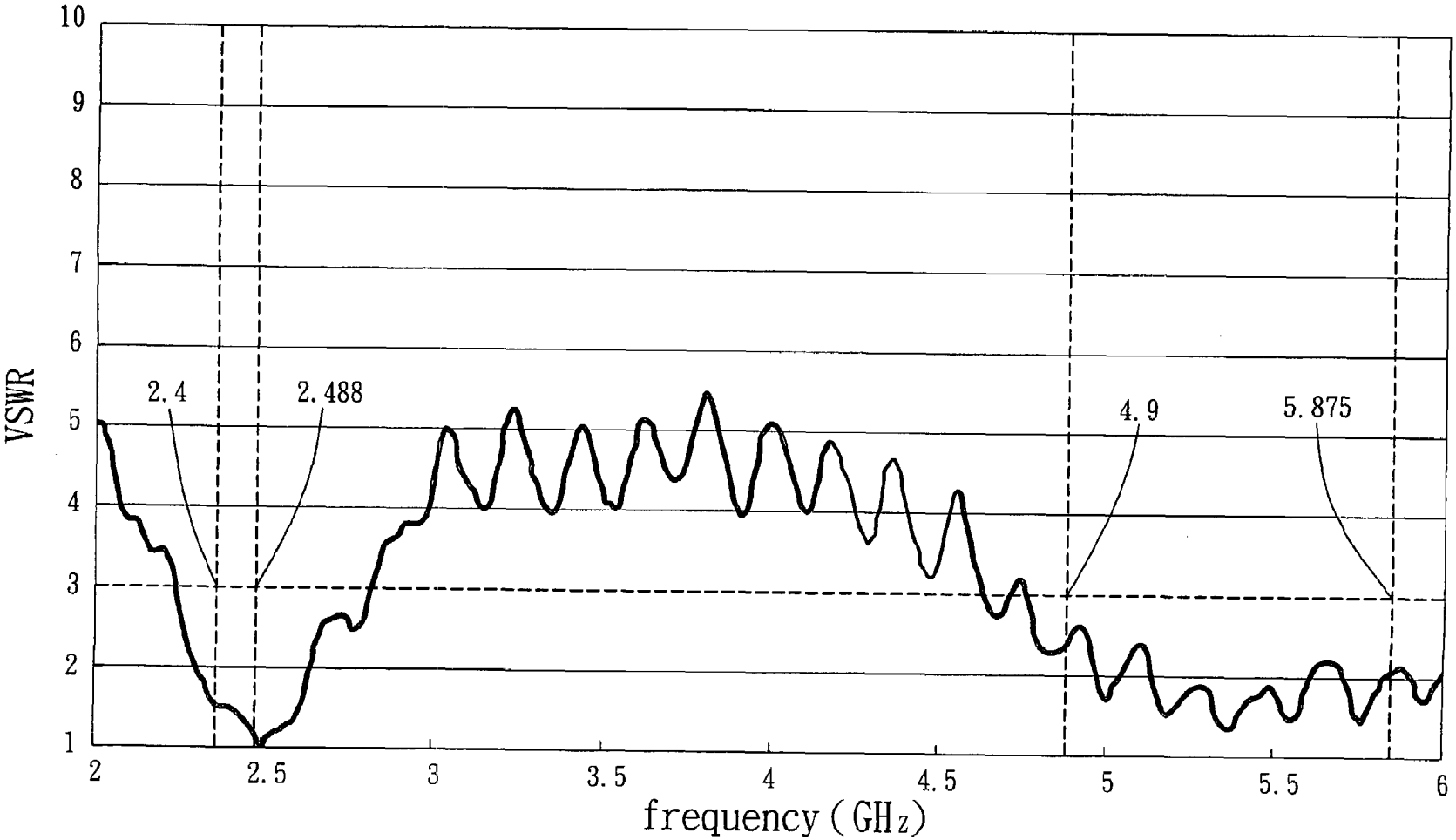
Figure 4:
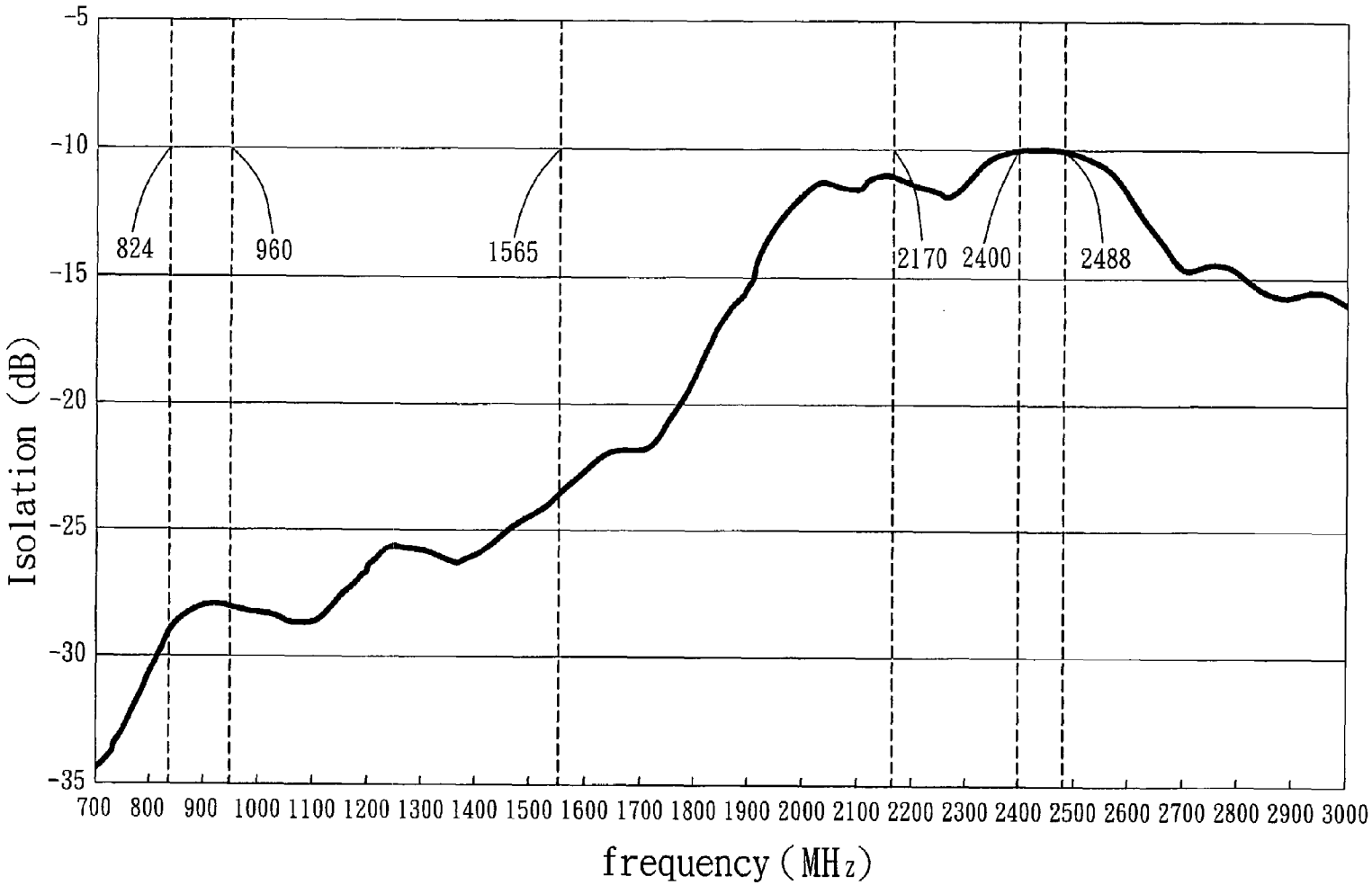
FIG. 4 is a plot illustrating an antenna isolation of the first preferred embodiment.
Figure 5:
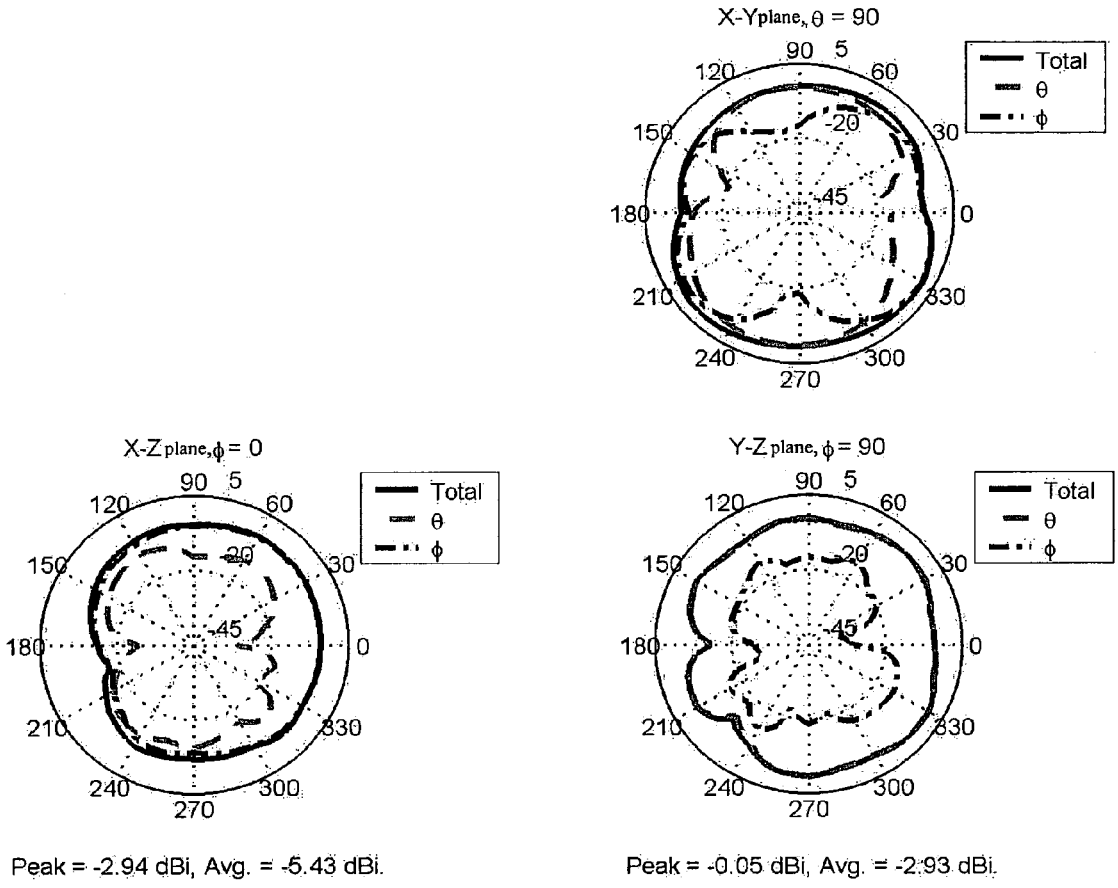
FIG. 5 shows plots of radiation patterns of the first preferred embodiment respectively on the x-y, x-z, and y-z planes when operated at 824 MHz.
Figure 6:
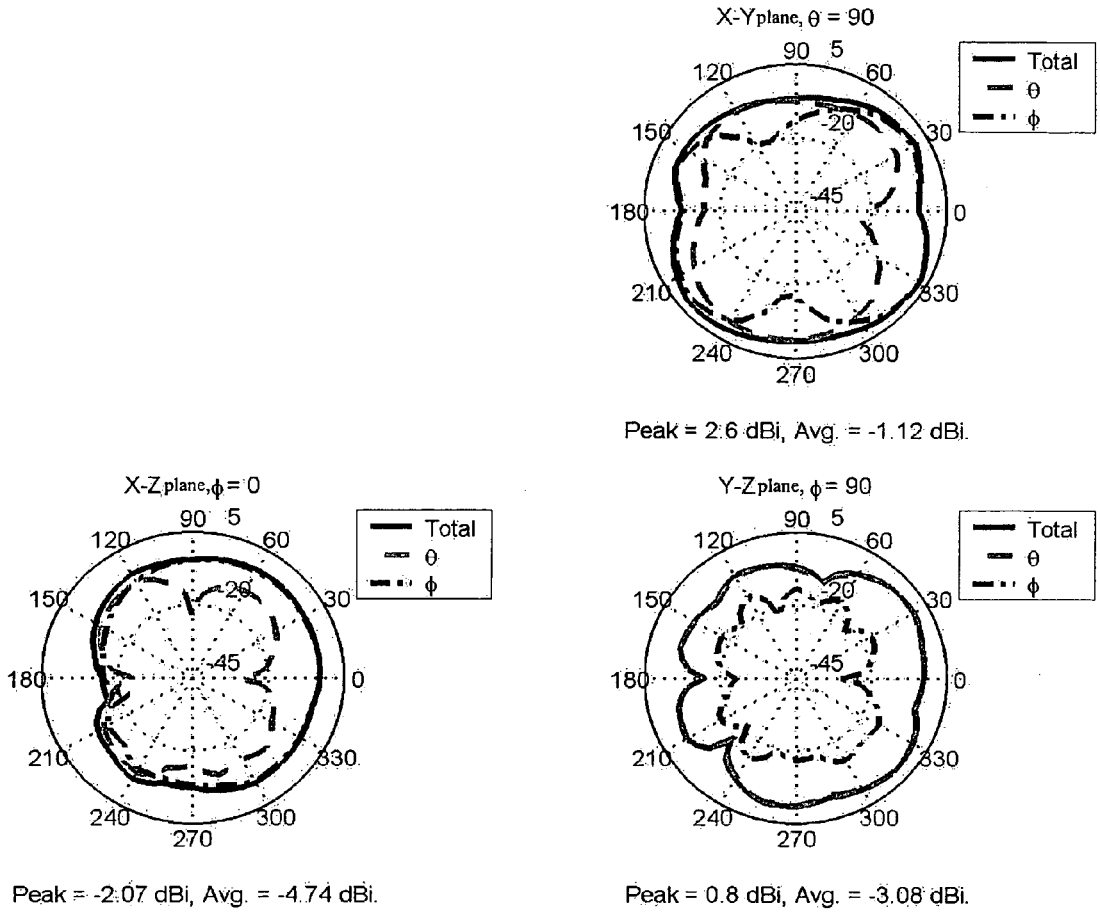
FIG. 6 shows plots of radiation patterns of the first preferred embodiment respectively on the x-y, x-z, and y-z planes when operated at 894 MHz.
Figure 7:
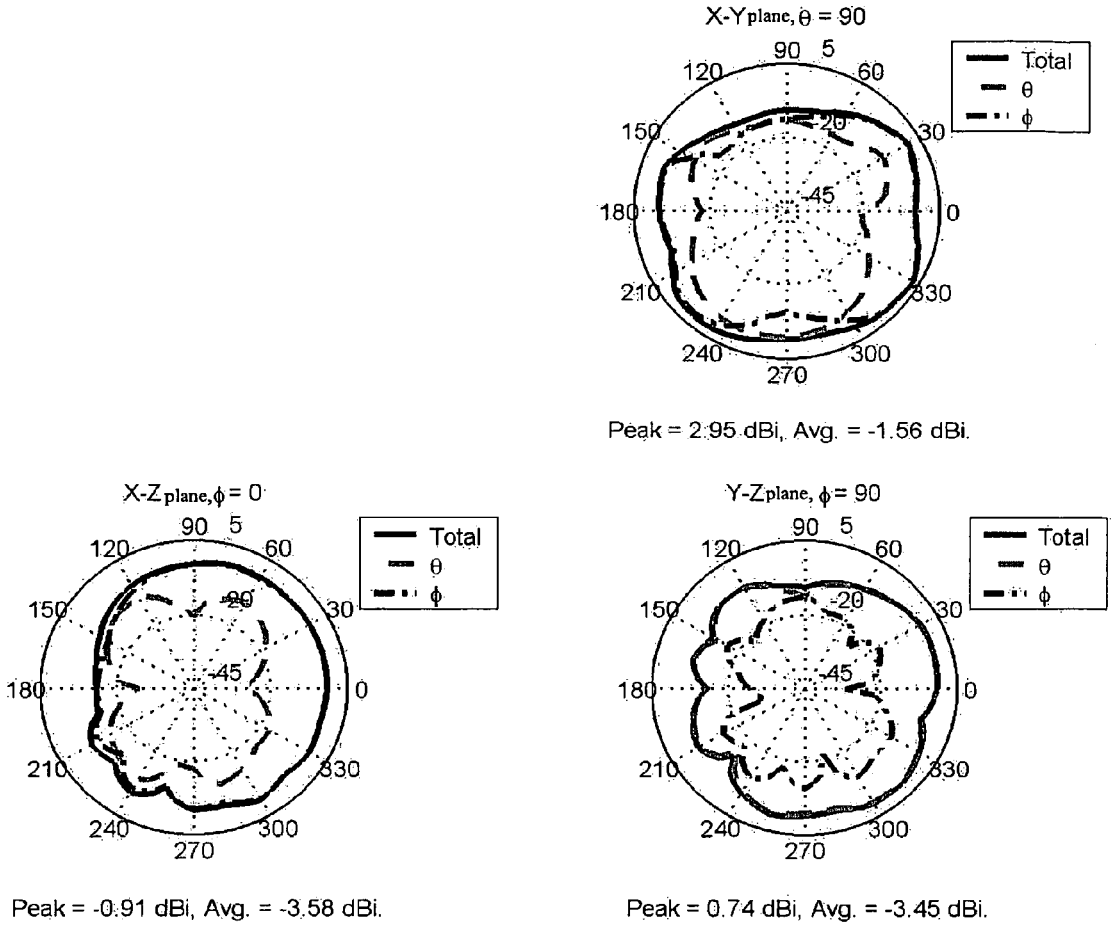
FIG. 7 shows plots of radiation patterns of the first preferred embodiment respectively on the x-y, x-z, and y-z planes when operated at 960 MHz.
Figure 8:
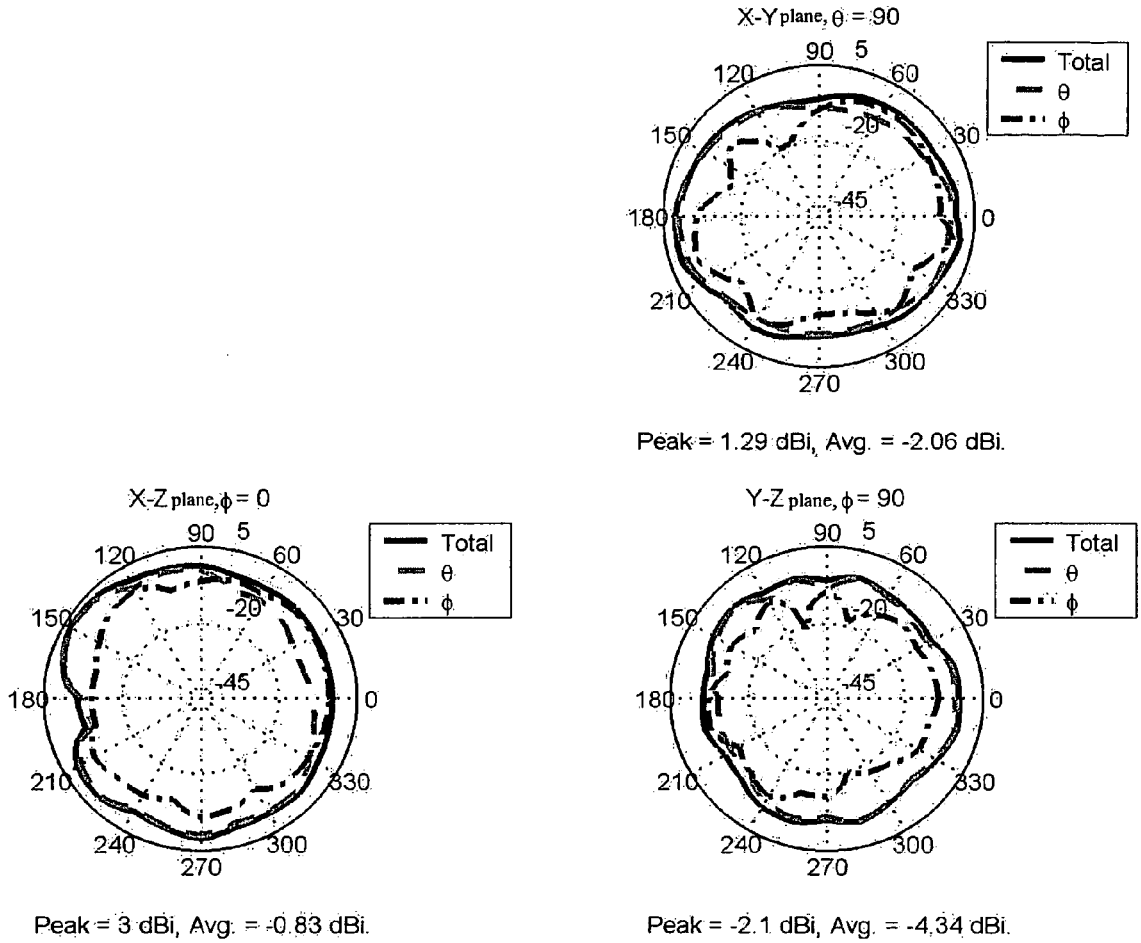
FIG. 8 shows plots of radiation patterns of the first preferred embodiment respectively on the x-y, x-z, and y-z planes when operated at 1710 MHz.
Figure 9:
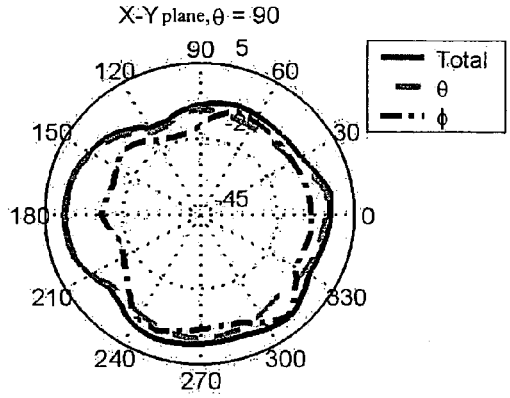
FIG. 9 shows plots of radiation patterns of the first preferred embodiment respectively on the x-y, x-z, and y-z planes when operated at 1880 MHz.
Figure 9:
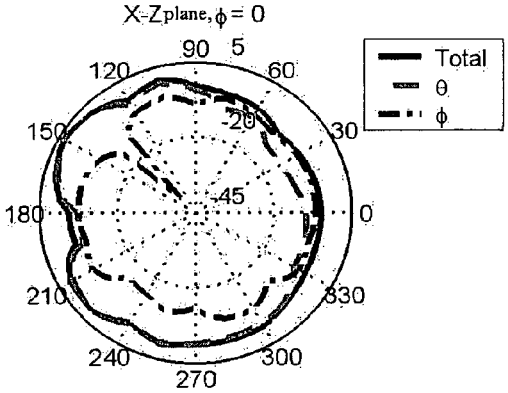
Figure 9:
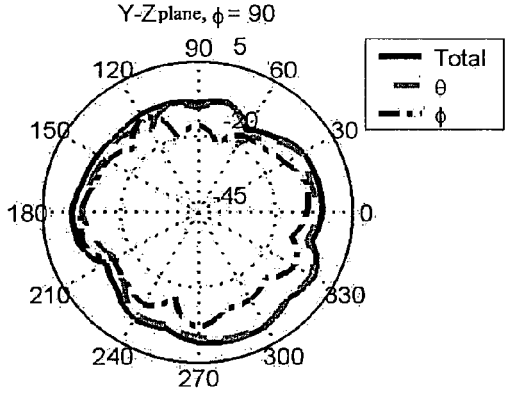
Figure 10:
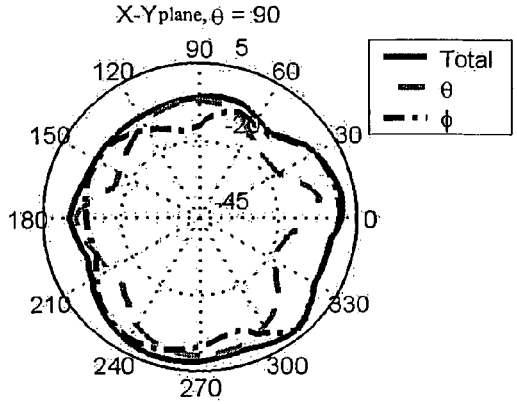
FIG. 10 shows plots of radiation patterns of the first preferred embodiment respectively on the x-y, x-z, and y-z planes when operated at 1990 MHz.
Figure 10:
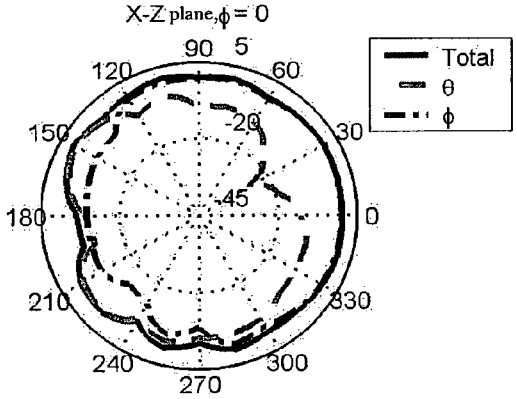
Figure 10:
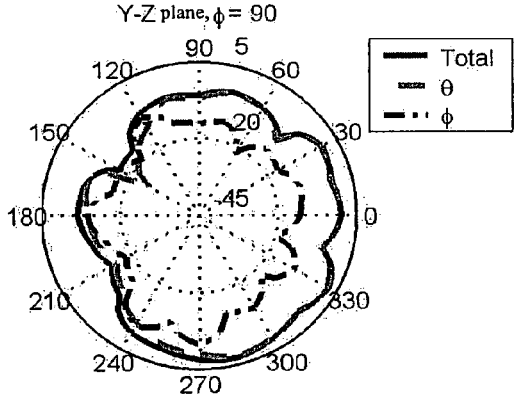
Figure 11:
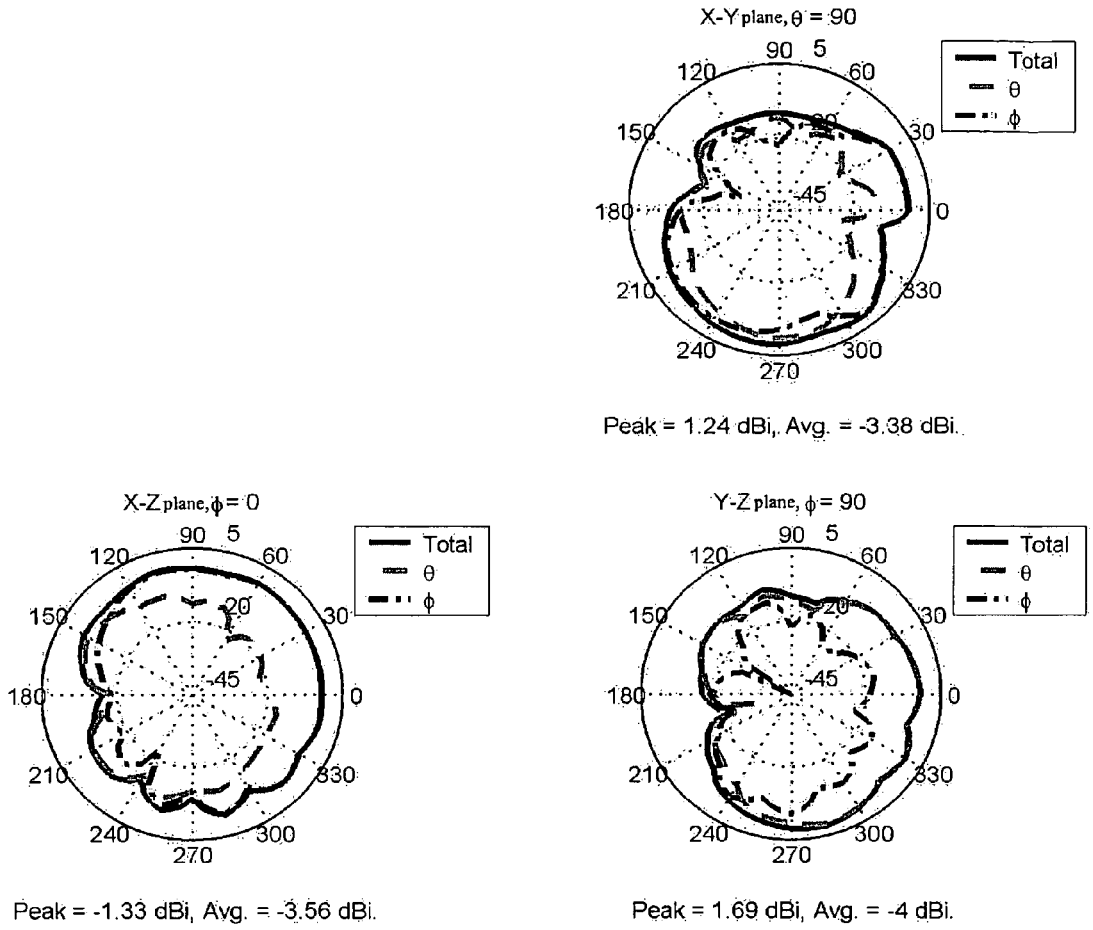
FIG. 11 shows plots of radiation patterns of the first preferred embodiment respectively on the x-y, x-z, and y-z planes when operated at 2170 MHz.
Figure 12:
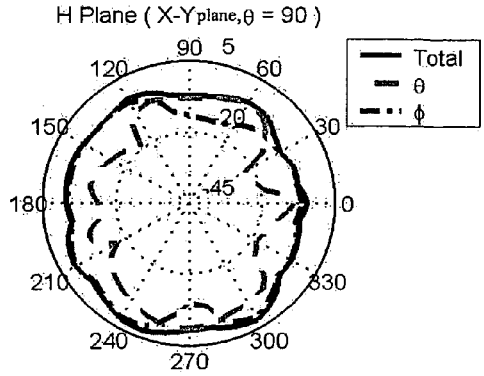
FIG. 12 shows plots of radiation patterns of the first preferred embodiment respectively on the x-y, x-z, and y-z planes when operated at 2412 MHz.
Figure 12:
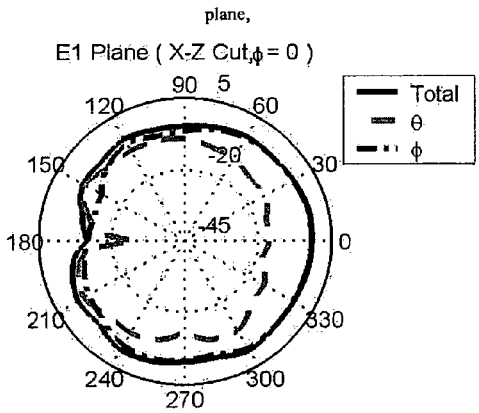
Figure 12:
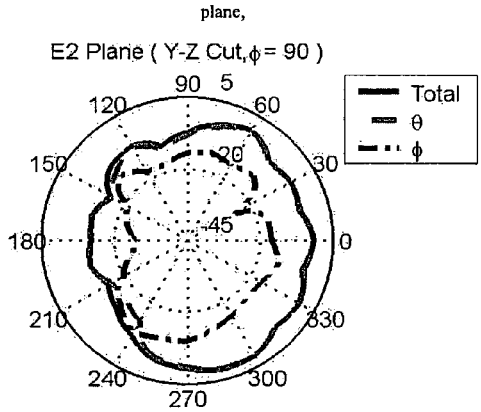
Figure 13:
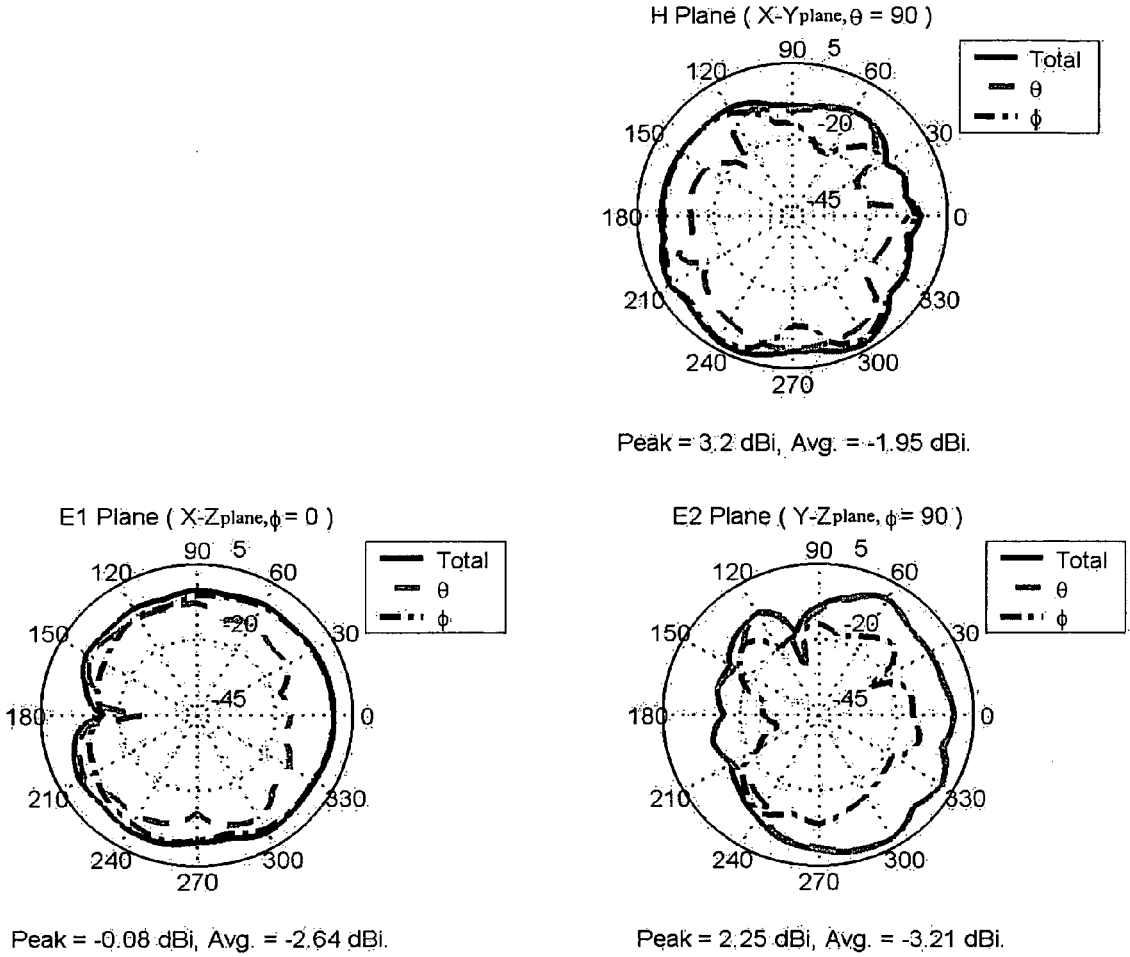
FIG. 13 shows plots of radiation patterns of the first preferred embodiment respectively on the x-y, x-z, and y-z planes when operated at 2437 MHz.
Figure 14:
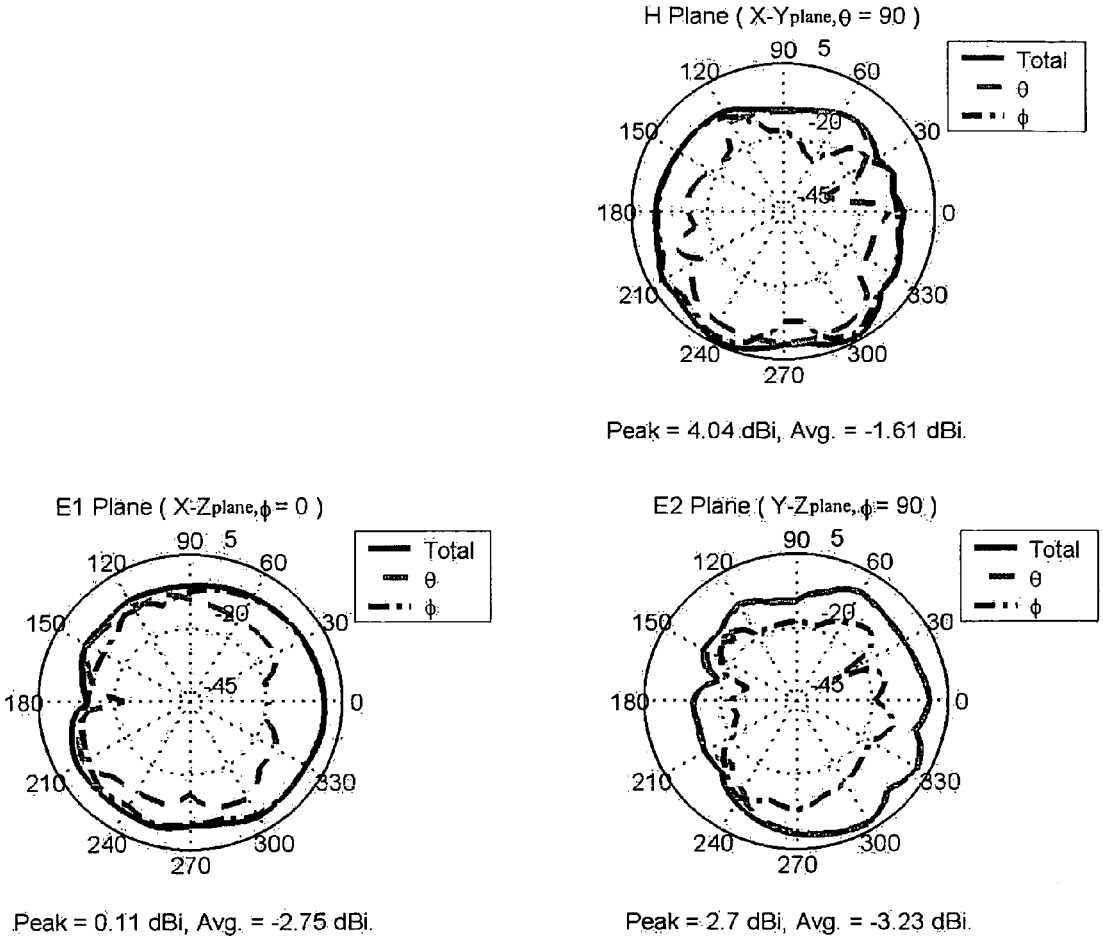
FIG. 14 shows plots of radiation patterns of the first preferred embodiment respectively on the x-y, x-z, and y-z planes when operated at 2462 MHz.
Figure 15:
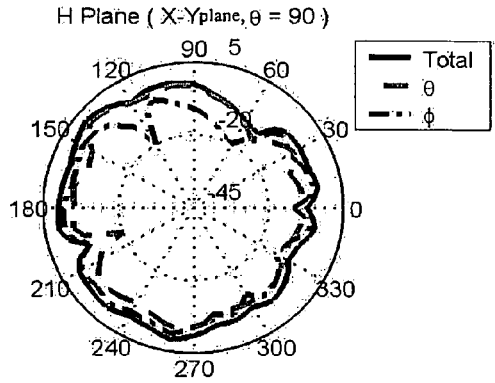
FIG. 15 shows plots of radiation patterns of the first preferred embodiment respectively on the x-y, x-z, and y-z planes when operated at 4900 MHz.
Figure 15:
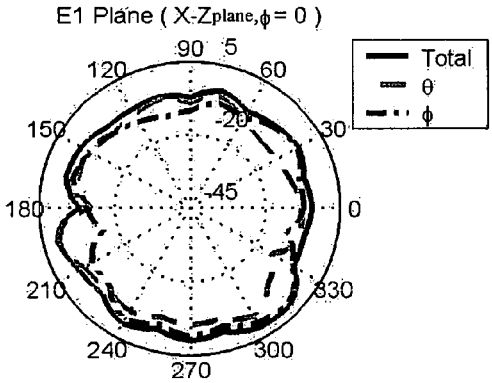
Figure 15:
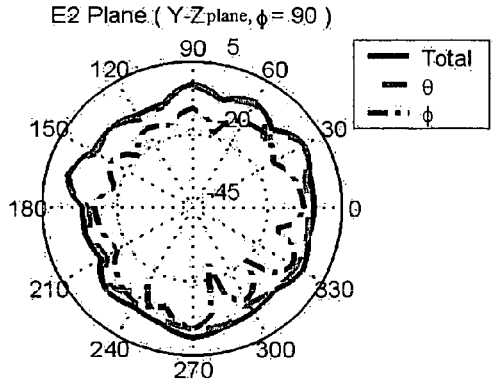
Figure 16:
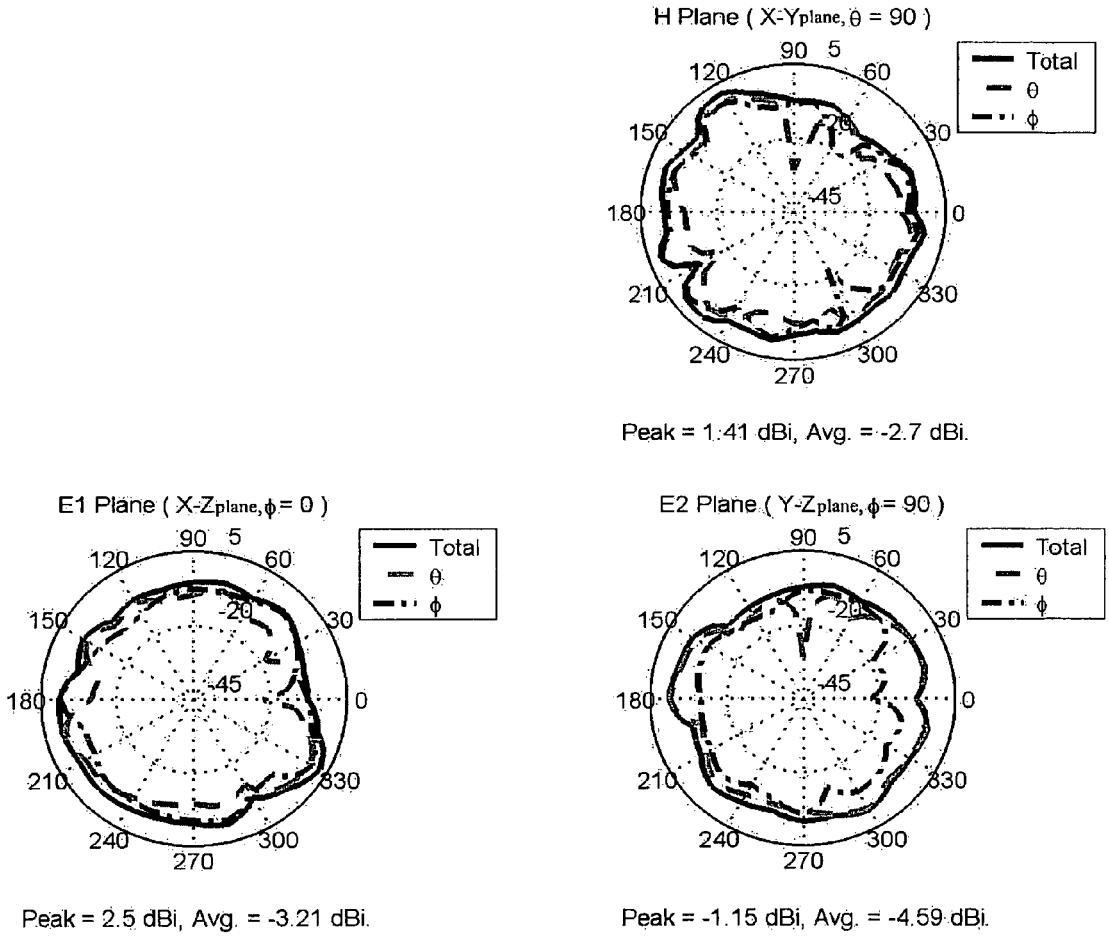
FIG. 16 shows plots of radiation patterns of the first preferred embodiment respectively on the x-y, x-z, and y-z planes when operated at 5150 MHz.
Figure 17:
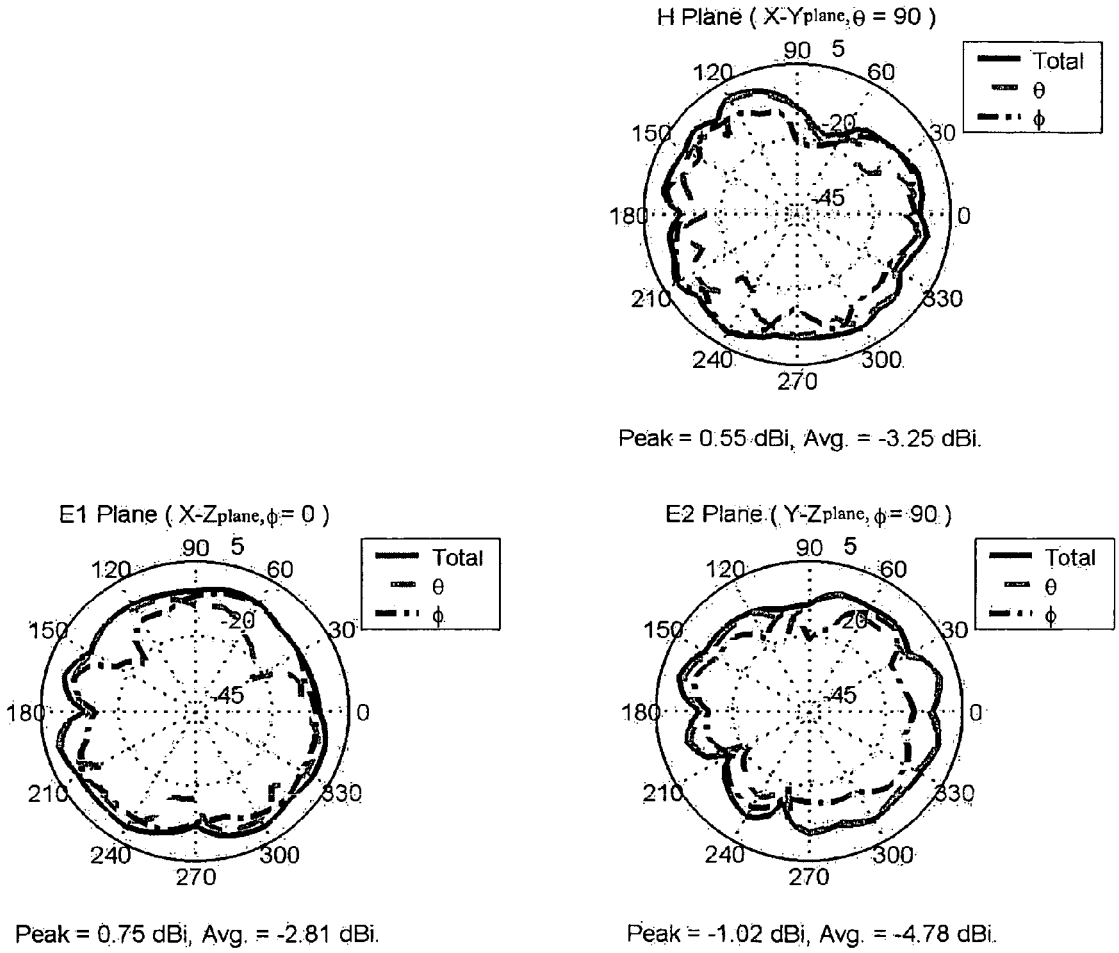
FIG. 17 shows plots of radiation patterns of the first preferred embodiment respectively on the x-y, x-z, and y-z planes when operated at 5350 MHz.
Figure 18:
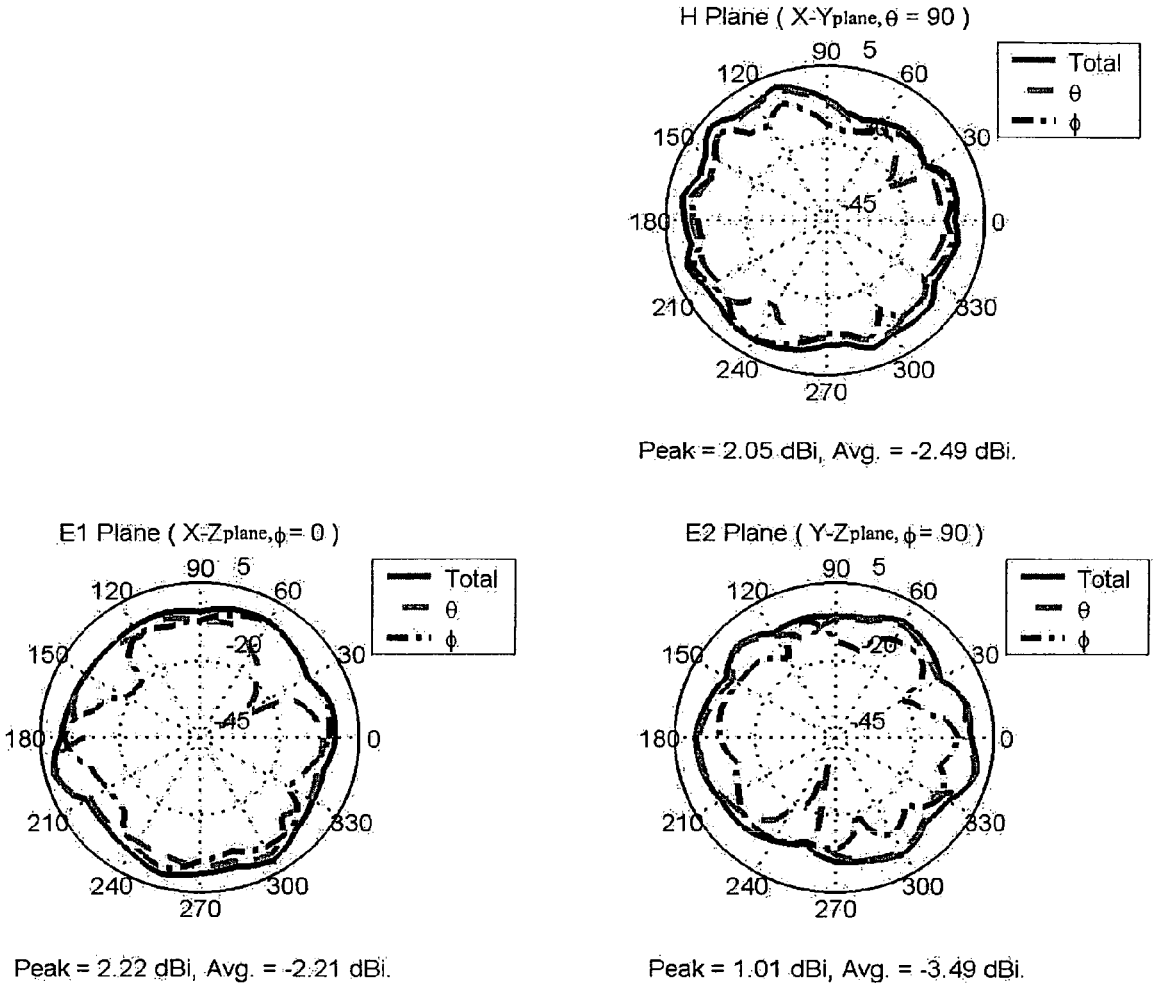
FIG. 18 shows plots of radiation patterns of the first preferred embodiment respectively on the x-y, x-z, and y-z planes when operated at 5470 MHz.
Figure 19:
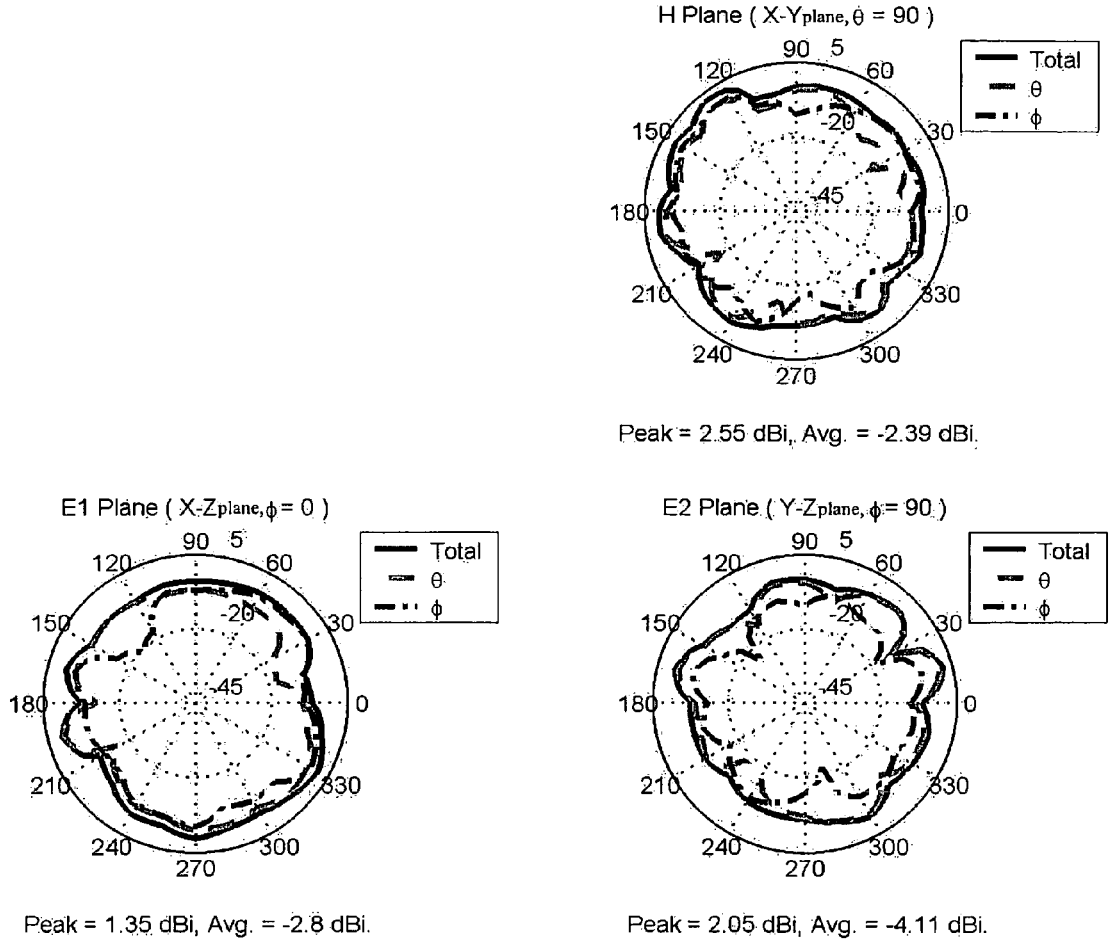
FIG. 19 shows plots of radiation patterns of the first preferred embodiment respectively on the x-y, x-z, and y-z planes when operated at 5725 MHz.
Figure 20:
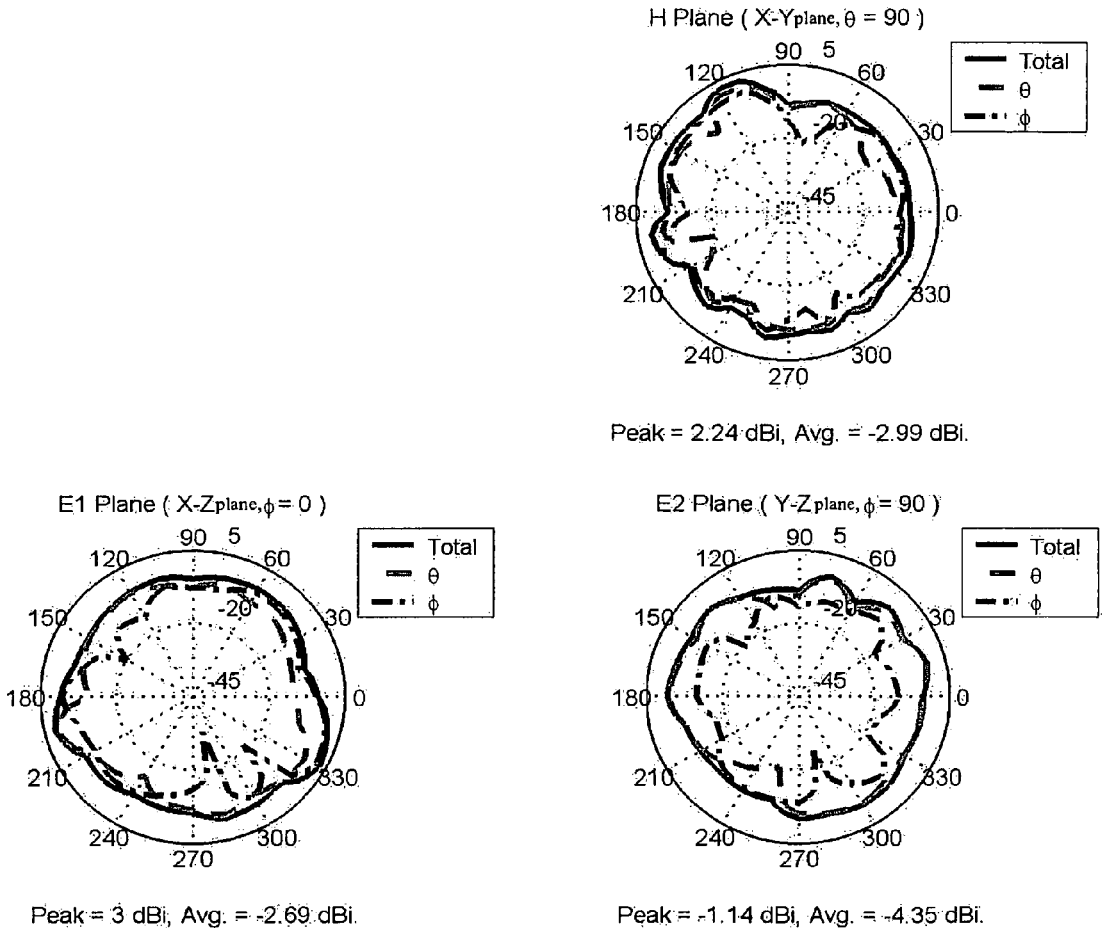
FIG. 20 shows plots of radiation patterns of the first preferred embodiment respectively on the x-y, x-z, and y-z planes when operated at 5875 MHz.
Figure 21:
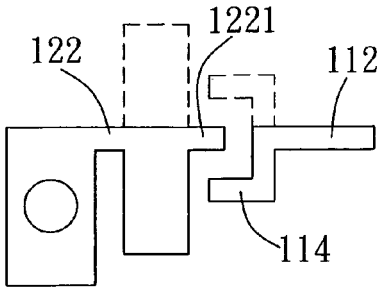
FIGS. 21 to 39 are schematic views to illustrate modified embodiments of the first preferred embodiment.
Figure 22:
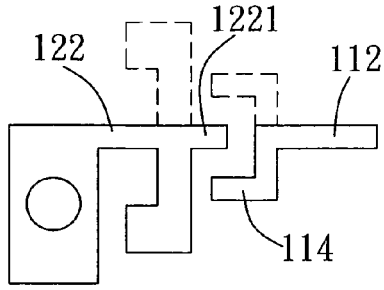
Figure 23:
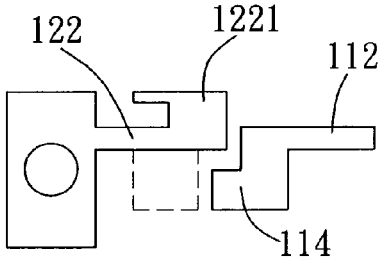
Figure 24:
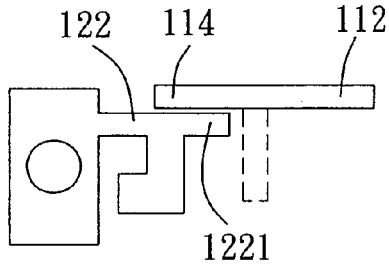
Figure 25:
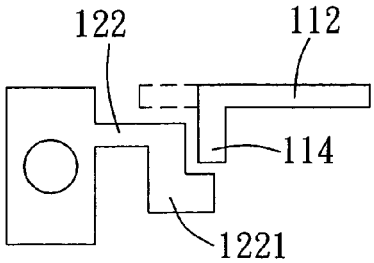
Figure 26:
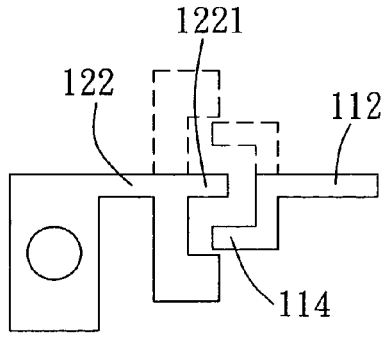
Figure 27:
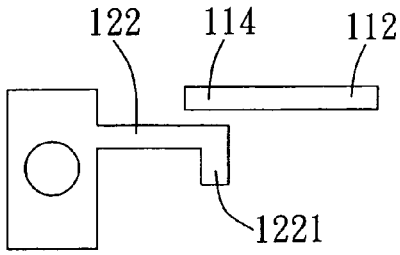
Figure 28:
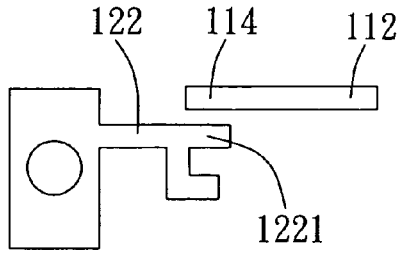
Figure 29:
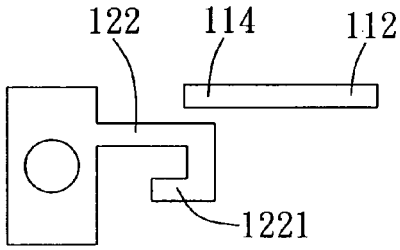
Figure 30:
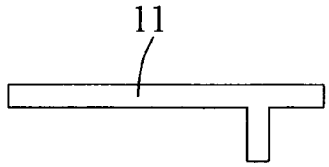
Figure 31:
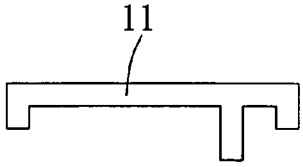
Figure 32:
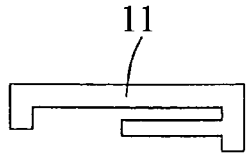
Figure 33:
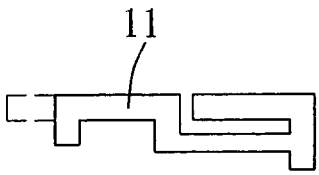
Figure 34:
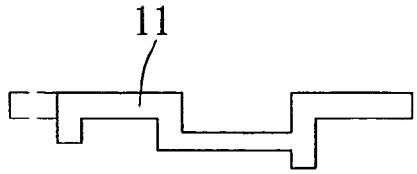
Figure 35:
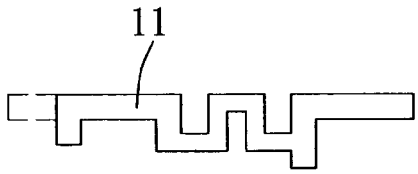
Figure 36:
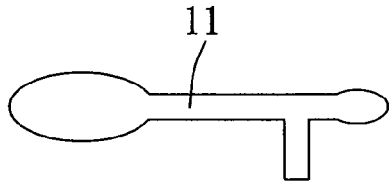
Figure 37:
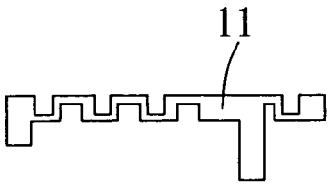
Figure 38:
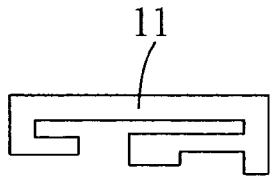
Figure 39:
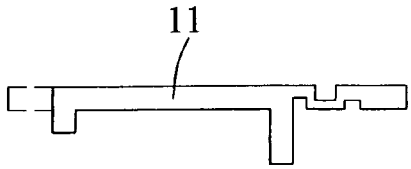

Based on experimental results, as illustrated in FIG. 2, the antenna device 1 of this embodiment achieves a voltage standing wave ratio (VSWR) of less than 3.0 when operated between 824 MHz and 960 MHz and between 1565 MHz and 2170 MHz. Moreover, as illustrated in FIG. 3, the antenna device 1 of this embodiment achieves voltage standing wave ratios (VSWRs) of less than 2.0 when operated between 2.4 GHz and 2.488 GHz, and less than 3.0 when operated between 4.9 GHz and 5.875 GHz. Further, as illustrated in FIG. 4, the antenna device 1 of this embodiment has an antenna isolation of less than 10 dB when operated between 824 MHz and 960 MHz, between 1565 MHz and 2170 MHz, and between 2400 MHz and 2488 MHz. As such, interference between the first and second antennas 11, 13 is significantly reduced. In addition, as illustrated in FIGS. 5 to 20, the antenna device 1 of this embodiment has substantially omnidirectional radiation patterns. Furthermore, as shown in Tables I and II, the antenna device 1 of this embodiment achieves satisfactory total radiation powers (TRP) and radiation efficiencies when operated between 824 MHz and 960 MHz, between 1565 and 2170 MHz, between 2412 MHz and 2462 MHz, and between 4900 MHz and 5875 MHz. Hence, the antenna device 1 of this embodiment is indeed suitable for WWAN and WLAN applications.

TABLE I

| Frequency (MHz) | TRP (dBm) | Radiation Efficiency (%) |
|---|---|---|
| 824 | −1.7 | 66.9 |
| 836 | −1.6 | 69.5 |
| 849 | −1.5 | 71.4 |
| 869 | −1.4 | 73.3 |
| 880 | −1.3 | 73.8 |
| 894 | −1.5 | 70.1 |
| 900 | −1.6 | 68.6 |
| 915 | −1.9 | 64.9 |
| 925 | −1.8 | 65.6 |
| 940 | −1.7 | 67.7 |
| 960 | −1.8 | 66.2 |
| 1575 | −4.2 | 37.6 |
| 1672 | −2.7 | 54.1 |
| 1710 | −1.8 | 66.0 |
| 1750 | −2.2 | 60.7 |
| 1785 | −3.0 | 49.9 |
| 1805 | −3.5 | 44.2 |
| 1840 | −3.9 | 40.4 |
| 1850 | −4.0 | 40.0 |
| 1880 | −3.4 | 45.5 |
| 1910 | −2.8 | 52.4 |
| 1920 | −2.6 | 55.4 |
| 1930 | −2.4 | 57.7 |
| 1950 | −2.4 | 58.0 |
| 1960 | −2.4 | 57.7 |
| 1980 | −2.4 | 57.7 |
| 1990 | −2.3 | 58.9 |
| 2110 | −4.1 | 38.7 |
| 2140 | −4.2 | 38.4 |
| 2170 | −4.5 | 35.5 |

TABLE II

| Frequency (MHz) | TRP (dBm) | Radiation Efficiency (%) |
|---|---|---|
| 2412 | −3.3 | 46.4 |
| 2437 | −2.9 | 51.1 |
| 2462 | −2.7 | 54.2 |
| 4900 | −3.4 | 45.5 |
| 5150 | −2.7 | 53.4 |
| 5350 | −2.7 | 53.8 |
| 5470 | −2.2 | 60.0 |
| 5725 | −2.1 | 61.6 |
| 5875 | −3.0 | 50.0 |

FIGS. 21 to 29 show modified embodiments of the first preferred embodiment according to this invention. In these embodiments, each of the coupling end portion 114 of the first radiating element 112 and the coupling end portion 1221 of the coupling element 122 is varied in shape.

FIGS. 30 to 39 show modified embodiments of the first preferred embodiment. In these embodiments, the first radiating element 11 is varied in shape.

Figure 40:
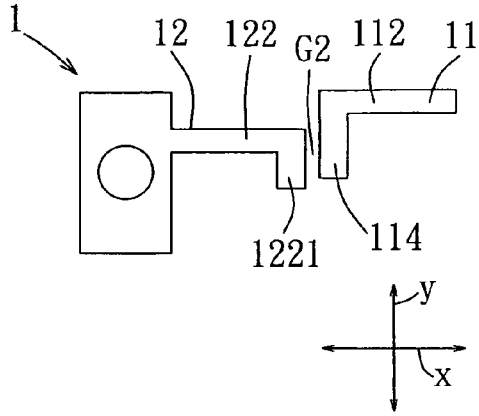
FIG. 40 is a schematic view of the second preferred embodiment of an antenna device according to this invention.
Figure 41:
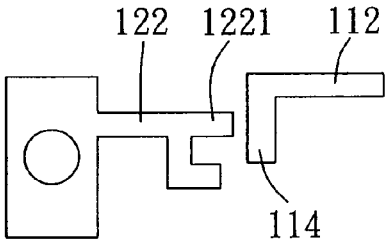
FIGS. 41 to 46 are schematic views to illustrate modified embodiments of the second preferred embodiment.
Figure 42:
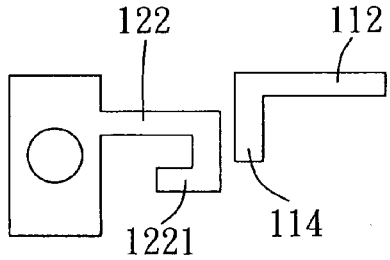
Figure 43:
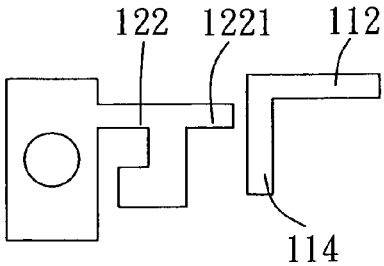
Figure 44:
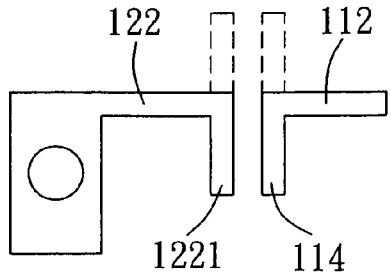
Figure 45:
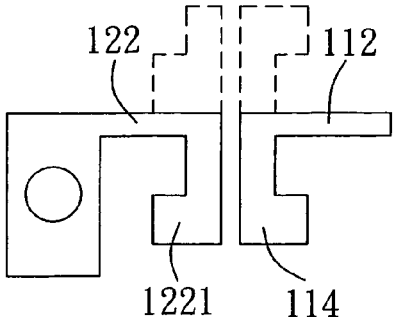
Figure 46:
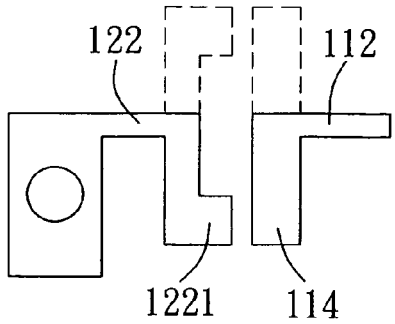

FIG. 40 illustrates the second preferred embodiment of an antenna device 1 according to this invention. When compared to the previous embodiments, the coupling end portion 114 of the first radiating element 112 of the first antenna 11 and the coupling end portion 1221 of the coupling element 122 of the parasitic coupler 12 overlap in the first direction (X), and cooperatively define a gap (G2) therebetween that ranges from 0.5 millimeters to 3.0 millimeters.

FIGS. 41 to 46 show modified embodiments of the second preferred embodiment. In these embodiments, each of the coupling end portion 114 of the first radiating element 112 and the coupling end portion 1221 of the coupling element 122 is varied in shape.

Figure 47:
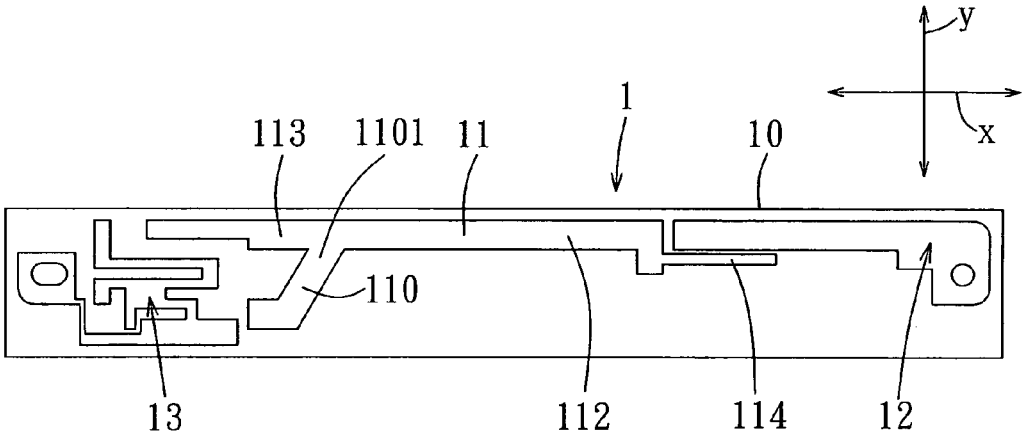
FIG. 47 is a schematic view of the third preferred embodiment of an antenna device according to this invention.

FIG. 47 illustrates the third preferred embodiment of an antenna device 1 according to this invention. When compared to the first preferred embodiment, the second antenna 13 and the parasitic coupler 12 are respectively disposed at the left and right sides of the dielectric substrate 10.

The first radiating element 112 extends in the first direction (X) from the right side of the first end 1101 of the first feeding element 110 away from the second antenna 13.

The second radiating element 113 extends in the first direction (X) from the left side of the first end 1101 of the first feeding element 110 away from the parasitic coupler 12.

Figure 48:
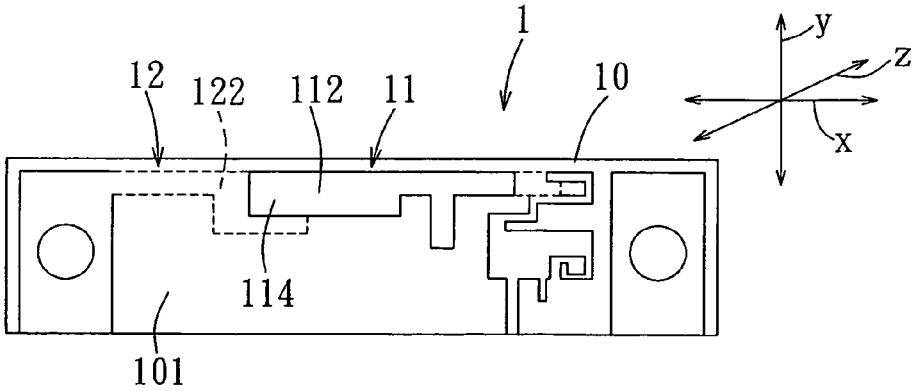
FIG. 48 is a schematic view of the fourth preferred embodiment of an antenna device according to this invention.
Figure 49:
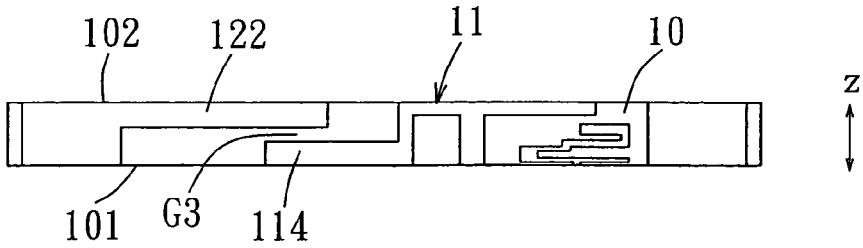
FIG. 49 is a schematic side view of the fourth preferred embodiment in FIG. 48.

FIG. 48 illustrates the fourth preferred embodiment of an antenna device 1 according to this invention. When compared to the first preferred embodiment, the coupling element 122 of the parasitic coupler 12 extends from the first surface 101 of the dielectric substrate 10 through the dielectric substrate 10, as best shown in FIG. 49, and is formed on the second surface 102 of the dielectric substrate 10. The coupling end portion 114 of the first radiating element 112 of the first antenna 11 and the coupling element 122 of the parasitic coupler 12 overlap in a third direction (Z) transverse to the first and second directions (X, Y) and cooperatively define a gap (G3) therebetween that ranges from 0.5 millimeters to 3.0 millimeters.

It is noted that the antenna device 1 of this embodiment may be implemented with the use of a double-sided printed circuit board.

Figure 50:
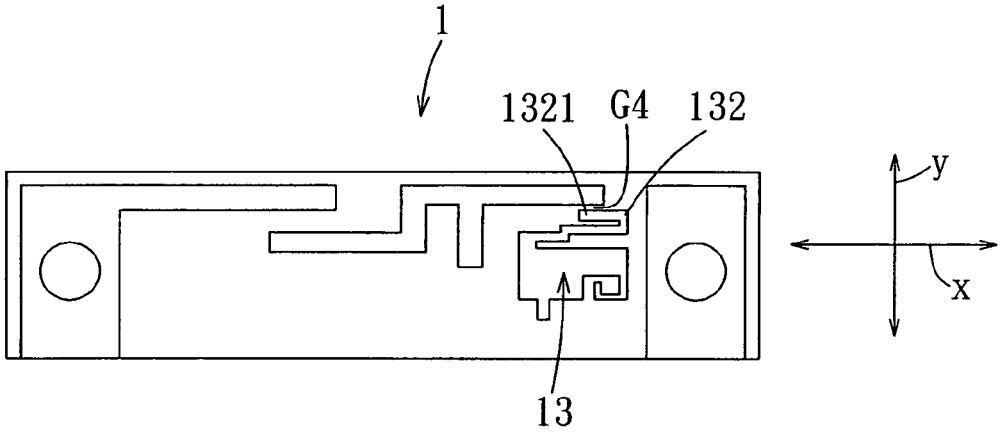
FIG. 50 is a schematic view of the fifth preferred embodiment of an antenna device according to this invention.
Figure 51:
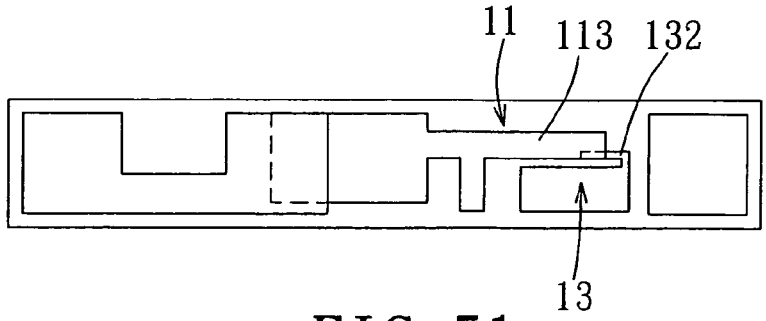
FIG. 51 is a schematic side view of the fifth preferred embodiment in FIG. 50.

FIGS. 50 and 51 illustrate the fifth preferred embodiment of an antenna device 1 according to this invention. When compared to the first preferred embodiment, the second radiating element 113 of the first antenna 11 and the end portion of third radiating element 132 of the second antenna 13 overlap in the second direction (Y) and cooperatively define a gap (G4) therebetween that ranges from 0.5 millimeters to 3.0 millimeters.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna device, comprising:

a dielectric substrate;

a first antenna formed on said dielectric substrate, and including a first feeding element that has opposite ends, a feeding point that is disposed at one of said ends of said first feeding element, and first and second radiating elements that respectively extend from opposite sides of the other one of said ends of said first feeding clement in opposite directions;

a parasitic coupler formed on said dielectric substrate, disposed proximate to said first radiating element, and including a first grounding element, and a coupling element that extends from said first grounding element and that is electromagnetically coupled to said first radiating element; and a second antenna formed on said dielectric substrate, spaced apart from said parasitic coupler in a first direction, disposed proximate to said second radiating element, and including a second feeding element that has opposite ends, a second feeding point that is disposed at one of said ends of said second feeding element, third and fourth radiating elements that respectively extend from opposite sides of the other one of said ends of said second feeding element, and a second grounding clement that extends from said second feeding element, wherein:

said first antenna is disposed between said parasitic coupler and said second antenna, said first radiating element extends in the first direction away from said second antenna, and said second radiating clement extends in the first direction away from said parasitic coupler.

2. The antenna device as claimed in claim 1, wherein said first radiating element and said coupling element cooperatively define a gap therebetween that ranges from 0.5 millimeters to 3.0 millimeters.

3. The antenna device as claimed in claim 1, wherein said first antenna operates in at least one of the third generation (3G) mobile communications system frequency range, the global positioning system (GPS) frequency range, and the digital video broadcasting-handheld (DVB-H) frequency range.

4. The antenna device as claimed in claim 1, wherein said second antenna operates in the 802.11 a/b/g frequency range.

5. The antenna device as claimed in claim 1, wherein said parasitic coupler further includes a securing clement that extends from said first grounding clement thereof and that is formed with a through-hole therethrough, said dielectric substrate being formed with a hole that is aligned with said through-hole in said securing element.

6. The antenna device as claimed in claim 1, wherein said second antenna further includes a securing element that extends from said second grounding element thereof and that is formed with a. through-hole therethrough, said dielectric substrate being formed with a hole that is aligned with said through-hole in said securing clement.

7. The antenna device as claimed in claim 1, wherein said dielectric substrate is made from a plastic material.

8. The antenna device as claimed in claim 1, wherein each of said first and second antennas and said parasitic coupler is made from one of a copper foil, iron, and a copper plate material.

9. The antenna device as claimed in claim 1, wherein said first antenna and said parasitic coupler are spaced apart from each other, and said first radiating element and said coupling element overlap each other.

10. The antenna device as claimed in claim 1, wherein said first antenna and said second antenna are spaced apart from each other, and said second radiating element and said third radiating element overlap each other.

* * * * *